US007176631B2

(12) United States Patent
Kanzaki

(10) Patent No.: US 7,176,631 B2
(45) Date of Patent: Feb. 13, 2007

(54) ULTRA HIGH PRESSURE DISCHARGE LAMP

(75) Inventor: Yoshitaka Kanzaki, Hyogo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 197 days.

(21) Appl. No.: 10/790,099

(22) Filed: Mar. 2, 2004

(65) Prior Publication Data

US 2004/0183442 A1 Sep. 23, 2004

(30) Foreign Application Priority Data

Mar. 3, 2003 (JP) ..... 2003-055410

(51) Int. Cl.
*H01J 17/18* (2006.01)

(52) U.S. Cl. ..... 313/623; 313/639; 313/318.07

(58) Field of Classification Search ..... 313/623, 313/639, 318.07; 228/127, 126, 129; 403/270
See application file for complete search history.

(56) References Cited

U.S. PATENT DOCUMENTS

| | | | | |
|---|---|---|---|---|
| 3,675,068 | A * | 7/1972 | Strauss | 313/623 |
| 5,109,181 | A | 4/1992 | Fischer et al. | |
| 5,200,669 | A * | 4/1993 | Dixon et al. | 313/623 |
| 5,430,353 | A * | 7/1995 | Feldman et al. | 313/623 |
| 5,497,049 | A | 3/1996 | Fischer | |
| 5,793,160 | A * | 8/1998 | Losco | 313/623 |
| 6,274,983 | B1 * | 8/2001 | Ooyama et al. | 313/632 |
| 6,563,267 | B1 * | 5/2003 | Van Den Nieuwenhuizen et al. | 313/594 |
| 2002/0031975 | A1 | 3/2002 | Kanzaki et al. | |
| 2002/0105272 | A1 * | 8/2002 | Takagaki et al. | 313/623 |

FOREIGN PATENT DOCUMENTS

| | | |
|---|---|---|
| JP | 02-148561 | 6/1990 |
| JP | 06-052830 | 2/1994 |

* cited by examiner

*Primary Examiner*—Ashok Patel
*Assistant Examiner*—Christopher Raabe
(74) *Attorney, Agent, or Firm*—Rader, Fishman & Grauer PLLC

(57) ABSTRACT

A short arc type high pressure discharge lamp has a pair of electrodes disposed inside the lamp and facing each other, a light emitting portion encapsulating more than 0.15 mg/mm$^3$ mercury, and sealing portions that extend to both sides of the light emitting portion, seal part of electrodes respectively, and join the electrodes and metallic foil, wherein a cross-sectional view of the metallic foil is an approximately omega shape.

7 Claims, 7 Drawing Sheets

FIG. 9

| NO | Film structure according to the present invention | Conventional film structure |
|---|---|---|
| 1 | 26.3 | 14.7 |
| 2 | 21.2 | 15.2 |
| 3 | 24 | 13 |
| 4 | 19.8 | 16.3 |
| 5 | 27.3 | 13.9 |
| 6 | 20.7 | 16.1 |
| 7 | 20.2 | 13.3 |
| 8 | 18.5 | 15.8 |
| 9 | 19.9 | 14.2 |
| 10 | 21.3 | 16.7 |
| Average value | 21.92 | 14.92 |
| Maximum value | 27.3 | 16.7 |
| Minimum value | 18.5 | 13 |
| Average of Max. value and Min. value | 22.9 | 14.85 |

ULTRA HIGH PRESSURE DISCHARGE LAMP

TECHNICAL FIELD OF THE INVENTION

The present invention relates to a short arc type ultra high pressure discharge lamp in which mercury vapor pressure is higher than 150 atm (atmospheric pressure) when the lamp is turned on, and more specifically, to a short arc type ultra high pressure discharge lamp which is used as a backlight of a liquid crystal display apparatus or a projector apparatus such as a DPL (digital light processor) using a DMD (digital mirror device).

DESCRIPTION OF RELATED ART

Since such a projection type projector apparatus is required to uniformly illuminate an image with sufficient color rendition onto a rectangular screen, a metal halide lamp encapsulating mercury or metal halide is employed as a light source. In addition, recently, such a metal halide lamp has been further miniaturized and made as a point light source, and furthermore halide lamps having an extremely short distance between electrodes have been put to practical use.

With such developments, recently, instead of such halide lamps, a new lamp having high mercury pressure of, for example 150 atm, has been proposed. The increase of mercury vapor pressure controls spread of arc and improves further light output.

Such an ultra high pressure discharge lamp is disclosed in Japanese Laid Open Patent Nos. 2-148561 and 6-52830.

Incidentally, since the pressure in an arc tube of such an ultra high pressure discharge lamp becomes extremely high, in sealing portions extending to both sides of a light emitting portion, it is necessary to make quartz glass sufficiently and tightly contact the sealing portion and electrodes, and metallic foil (film) for power supply. Poor adhesiveness causes a leak of encapsulated gas and may lead to cracks.

Therefore, in a sealing process of the sealing portions, for example, the quartz glass is heated at high temperature of 2000° C., and in that state, the thick quartz glass is gradually contracted thereby increasing adhesiveness of the sealing portion.

However, when the quartz glass is heated at a too high temperature, although the adhesiveness between the quartz glass and the electrode or the metallic foil is improved, there is a problem that the sealing portions are easy to break after the completion of a discharge lamp.

That is, in the stage in which the temperature of the sealing portions gradually decreases after the heat processing, a relative expansion and contraction amount of the electrode and the sealing portions differs due to difference between expansion coefficient of material (tungsten) comprising the electrode and that of material comprising the sealing portion (quartz glass), thereby causing cracks at a contacting portion thereof.

Although these cracks are very small, the cracks grow due to an ultra high pressure state when the lamp is turned on, thereby causing a break of the discharge lamp.

In FIG. 7, a structure to solve the problem of the conventional short arc type high pressure discharge lamp is shown. In the figure, a light emitting portion 2 of a discharge lamp 1 is connected to sealing portions 3, and electrodes 6 and 7 are joined with a metallic foil (film) 8 in the respective sealing portions 3. Coil members 10 are wound around respectively part of the electrodes where the electrodes 6 and 7 are buried in the respective sealing portions 3.

Such a structure helps to control stress to the quartz glass, which is attributed to thermal expansion of electrodes (electrode rods), by the coil members 10 wound around the respective electrode rods. For example, such structure is disclosed in Japanese Laid Open Patent No. 11-176385.

However, even though the thermal expansion of electrodes is reduced by such a structure, from a practical standpoint, there remain cracks around the electrodes 6 and 7 or the coil member 10.

Although these cracks are very small, in case that the mercury vapor pressure of the light emitting portion 2 is 150 atm, the cracks sometimes cause break of the sealing portions 3. In addition, recently, very high mercury vapor pressure such as 200 to 300 atm is required, and in such a high mercury vapor pressure, the cracks grow when the lamp is turned on, and, as a result, breaks of the sealing portions 3 take place notably. That is, even though the cracks are very small, they gradually grow when the lamp is turned on under the high mercury vapor pressure.

Such a problem does not ever exist in a mercury lamp having approximately 50 to 100 atm when the lamp is turned on. This problem is new technological subject matter.

SUMMARY OF THE INVENTION

In view of the above problems, the present invention provides a structure having sufficiently high pressure withstanding characteristic in an ultra high pressure mercury lamp in which the lamp is turned on under an extremely high mercury vapor pressure.

To solve the problem, the present invention is to provide a short arc type high pressure discharge lamp comprising a pair of electrodes disposed inside the lamp and facing each other, a light emitting portion containing more than 0.15 $mg/mm^3$ mercury, and sealing portions that extend to both sides of the light emitting portion, seal part of electrodes respectively, and join the electrodes and metallic foil (film), wherein a cross-sectional view of the metallic foil is an approximately omega (Ω)shape.

In addition, according to the present invention, in a joint portion of at least one of the electrodes and the metallic foil (film), there are at least two welding traces welded from a width direction of the metallic foil.

Further, according to the present invention, a method of welding an electrode and a metallic foil, comprising steps of preparing a metallic foil having a curved surface portion wherein a cross-sectional view of the metallic foil is an approximately omega shape, placing the electrode in the curved surface, and welding from a width direction of the metallic foil.

According to the present invention, it is possible to make air gaps small in the sealing portions by employing the structure of the short arc type ultra high pressure discharge lamp described above, thereby completely preventing the generation and growth of cracks.

The inventor discovered that in the conventional joint of the metallic foil and electrodes, as shown in FIG. 8, the air gaps X between the metallic foil 8 and the electrode 7 are unavoidably created, and the generation and growth of the gaps is affected by applying extremely high pressure in the light emitting portion to the air gaps X.

That is, as described above, even though the difference between the thermal expansion coefficient of the electrodes and that of the sealing portions is reduced by winding the respective coil members around the electrodes, since the gaps X cannot be completely eliminated, the generation and growth of the cracks cannot be sufficiently prevented.

By employing the new structure described above, it is possible to weld the electrodes and the metallic foil well in the sealing portions, and to make the air gaps X to be extremely small in size and to prevent creation of the gaps X to the extent that, from a practical viewpoint, almost no crack is created.

The present invention will become more apparent from the following detailed description of the embodiments and examples of the present invention.

DESCRIPTION OF THE DRAWINGS

FIG. 9 shows results of experiments according to the present invention; and

DETAILED DESCRIPTION OF THE INVENTION

Embodiments of the present invention will be described below with reference to the accompanying drawings.

Figure 1:
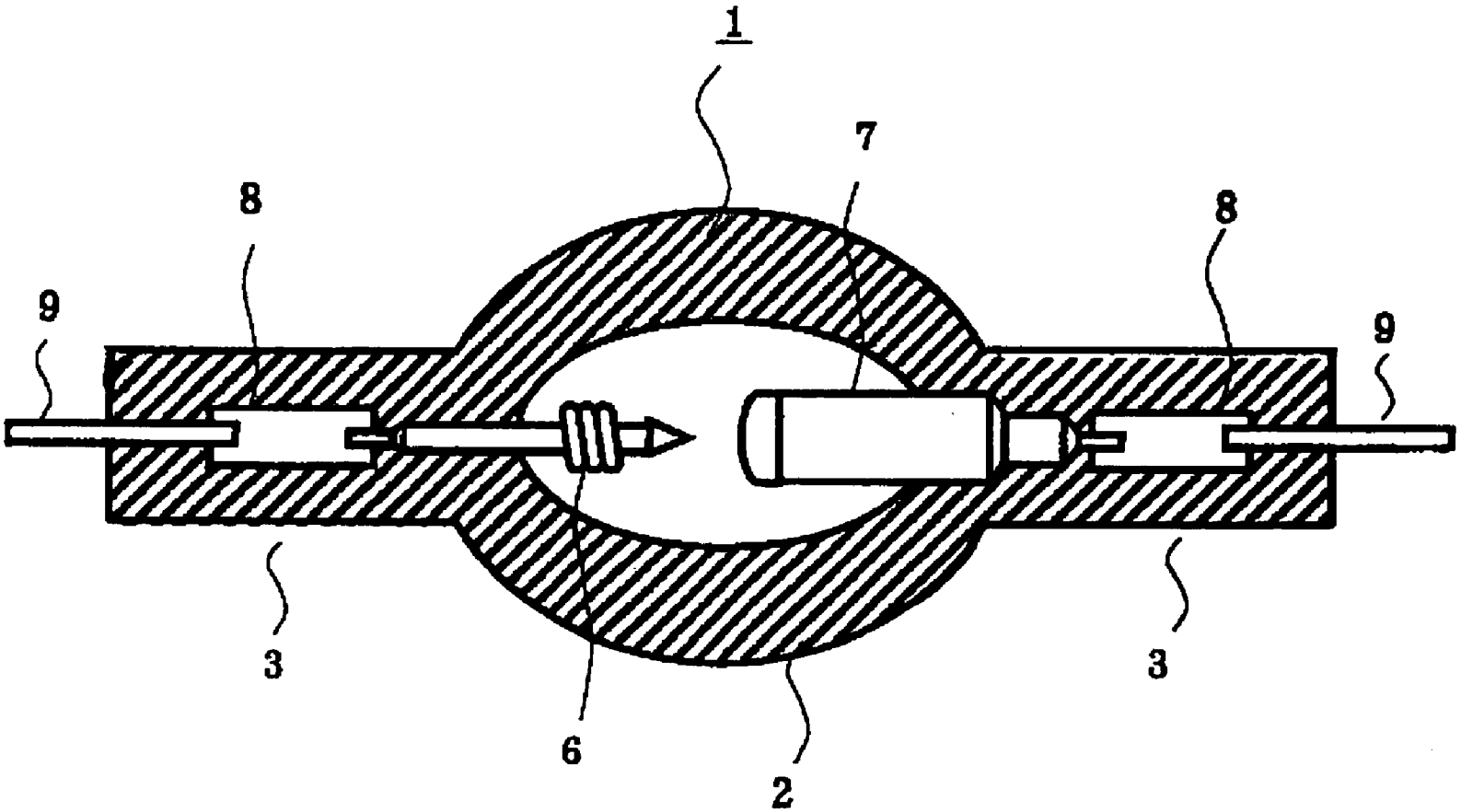
FIG. 1 is a diagram showing the structure of an ultra high pressure discharge lamp according to the present invention is shown.

In FIG. 1, a structure of an ultra high pressure discharge lamp according to the present invention is shown. Hereinafter referred to merely as "a discharge lamp."

The discharge lamp 1 has a light emitting portion 2 whose shape is approximately spherical. The light emitting portion 2 is formed as part of a discharge container made of quartz glass. In the light emitting portion 2, a cathode 6 and an anode 7 are disposed so as to face each other. A sealing portion 3 is formed on each side of the light emitting portion 2 so as to extend therefrom. In these sealing portions 3, metallic foils (foil) 8 for electric conduction are air-tightly buried by, for example, shrink-sealing. The metallic foils 8 are usually made of molybdenum. One end of one of the metallic foils 8 is connected to the cathode 6 and one end of the other metallic foil is connected to the anode 7. The other end of each metallic foils 8 are connected to respective outside leads 9.

A rod shape portion of the cathode or anode which is connected to the metallic foil 8 is sometimes referred to differently from the cathode and anode. However, in the present invention, the cathode and anode mean that they include the rod shape portion unless particular reference is made.

In the light emitting portion 2, mercury, rare gas and halogen gas are encapsulated. More than 0.15 mg/mm$^3$ mercury is encapsulated therein in order to obtain radiation light with a necessary visible light-wavelength of, for example, a 360 to 780 nm wavelength. Although encapsulated amount thereof differs depending on temperature condition, significantly high vapor pressure can be obtained if it is more than 150 atmosphere when the lamp is turned on. In addition, it is possible to produce a discharge lamp with a high mercury vapor pressure such as more than 200 to 300 atm (atmospheric pressure) when a larger amount of mercury is encapsulated. As the mercury vapor pressure is high, it is possible to realize a light source suitable for a projector apparatus.

For rare gas, for example, argon gas (13 kPa) is encapsulated thereby improving a starting-up performance.

Halogen, in form of compound of mercury or other metal with iodine, bromine, chlorine and the like, is encapsulated therein. The encapsulated amount is, for example, in a range of $10^{-6}$ to $10^{-2}$ μmmol/mm$^3$. It functions to extend the life of the discharge lamp using halogen cycle. In case that as in the present invention, the discharge lamp is very small and the discharge lamp has high pressure therein, it is likely that encapsulating halogen prevents breakage and devitrification of the discharge lamp.

For example, the outer diameter of the light emitting portion is selected in a range of ϕ6.0 to 15.0 mm, such as 9.5 mm. A distance between the electrodes is selected in a range of 0.5 to 2.0 mm, such as 1.5 mm. The volume of the light emitting tube is selected in a range of 40 to 200 mm$^3$, such as 75 mm$^3$. Further, for lighting condition, tube wall load, rated voltage, and rated apparent power are 1.5W/mm$^2$, 80 V, and 150 W, respectively.

The discharge lamp is installed in a presentation apparatus such as a projector apparatus, and an overhead projector wherein good color rendition can be obtained.

Figure 2:
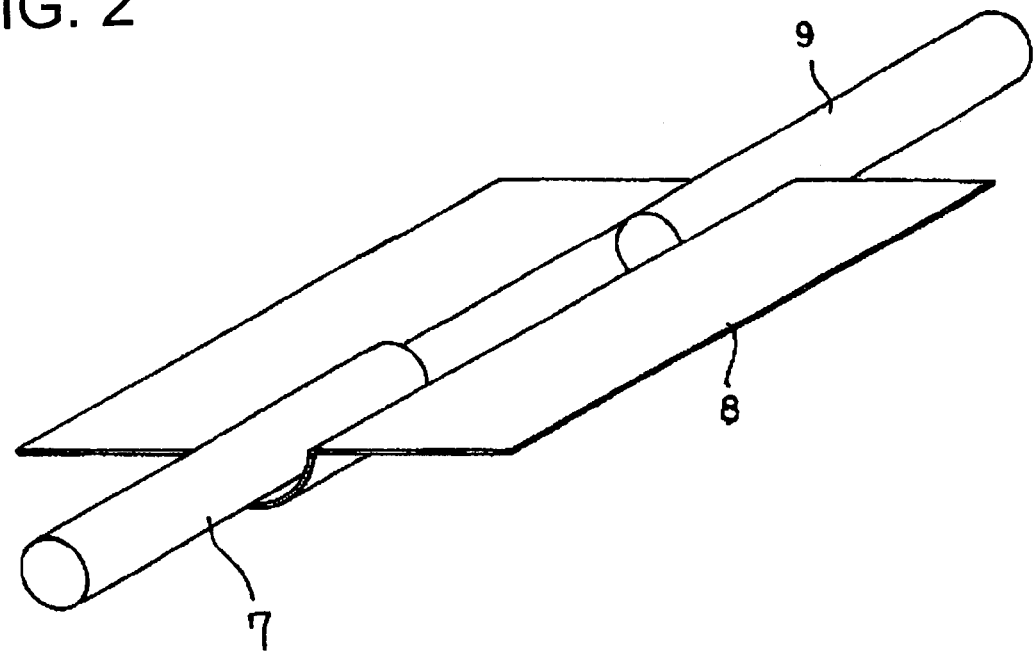
FIG. 2 is a schematic view of a joint of an electrode of the discharge lamp and a metallic foil according to the present invention.

FIG. 2 is a schematic view of a joint of the electrode 7 of the discharge lamp and the metallic foil according to the present invention. In this embodiment, the anode 7 is shown in the figure for convenience, but the anode 7 can be replaced with the cathode 6.

A cross-sectional view of the metallic foil is an approximately omega-shape (Ω shape). The electrode 7 and the outer lead 9 are fit in a center curved portion of the metallic foil 8. In the figure, part of a connecting end portion of the electrode 7 and that of the outer lead 9 are shown for illustrative purpose. Further, the metallic foil 8 is illustrated in the figure so that the length in the longitudinal direction is shorter than actual one for convenience.

Figure 8:
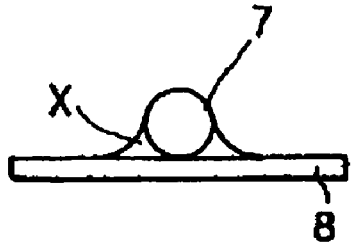
FIG. 8 shows a conventional joint of a metallic foil and an electrode.

Since the cross-sectional view of the metallic foil is omega-shaped (see FIG. 3A), the metallic foil 8 is formed so as to be wound around the electrode 9. The air gap X shown in FIG. 8 is removed or remarkably reduced. As a result, cracks may occur with significantly decreasing frequency.

Furthermore, since the electrode 7 and the outer lead 9 are fit in the center curved portion 8a of the metallic foil 8, in a manufacturing process of the sealing portion, they are not undesirably off to the side, thereby positioning them in an accurate direction.

Figure 3A:
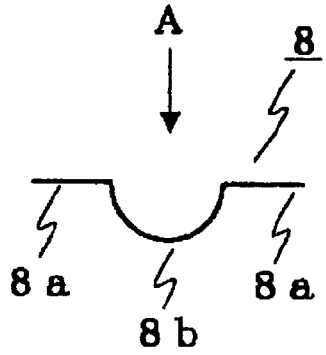
FIG. 3A is an enlarged cross sectional view of the metallic foil according to the present invention.
Figure 3B:
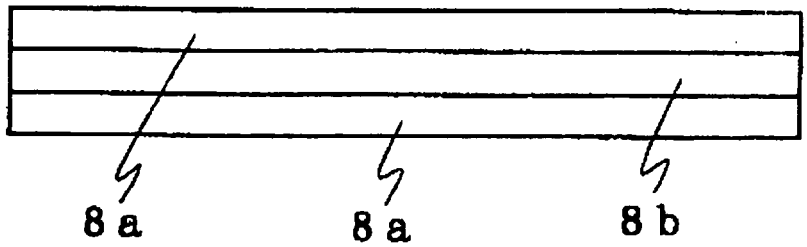
FIG. 3B is a top plan view thereof in the direction of an arrow A shown in FIG. 3A.

FIG. 3A is an enlarged cross sectional view of the metallic foil 8. FIG. 3B is a top plan view thereof, viewing in the direction shown by an arrow A in FIG. 3A.

The metallic foil 8 comprises plain surface portions 8*a* which are located on both sides thereof and the center curved surface portion 8*b* wherein the film 8 is approximately omega-shaped (see FIG. 3A). The film 8 is omega-shaped so as to stretch the length of the metallic foil 8.

The full length of the metallic foil 8 is selected in a range of 8.0 to 30.0 mm, such as 11.00 mm. The width of the metallic foil 8 is selected in a range of 1.0 to 4.0 mm, such as 1.5 mm. For example the width of each of the plain portions 8*a* is 0.25 mm. The total width of the two plain portions 8*a* is 0.5 mm. The width of the curved surface portion 8*b* is about 1.0 mm. The width of the curved surface portion 8*b* of the metallic foil 8 should be preferably selected so that the diameter of the electrode 7 and that of the lead 9 fit therein as described above. The electrode diameter is selected in a range of ϕ0.3 to 1.5 mm, such as ϕ1.0 mm. The thickness of the metallic foil 8 is selected in a range of 10 to 40 μm, such as 20 μm.

Figure 4A:
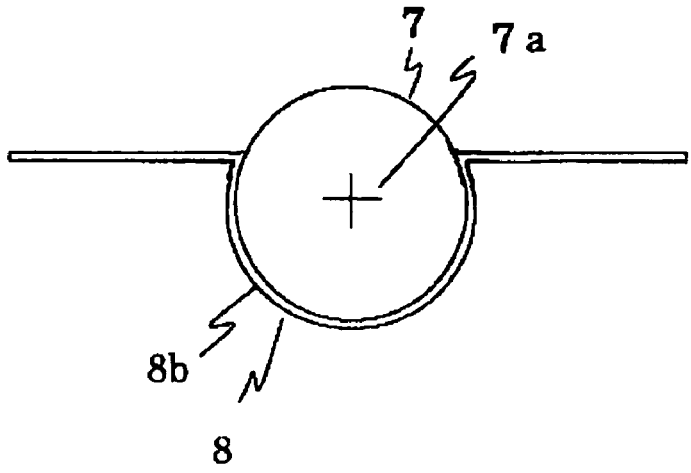
FIG. 4A is a diagram of the electrode and the metallic foil which are joined wherein more than half of the electrode is fit in a curved portion 8*b;*
Figure 4B:
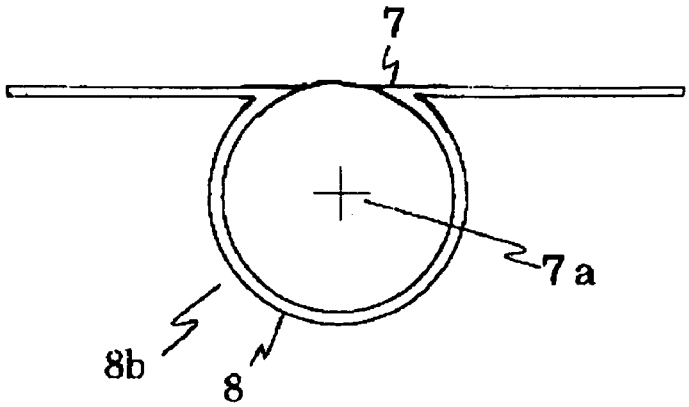
FIG. 4B is a diagram thereof wherein almost entire electrode is fit in the curved portion 8*b;*
Figure 4C:
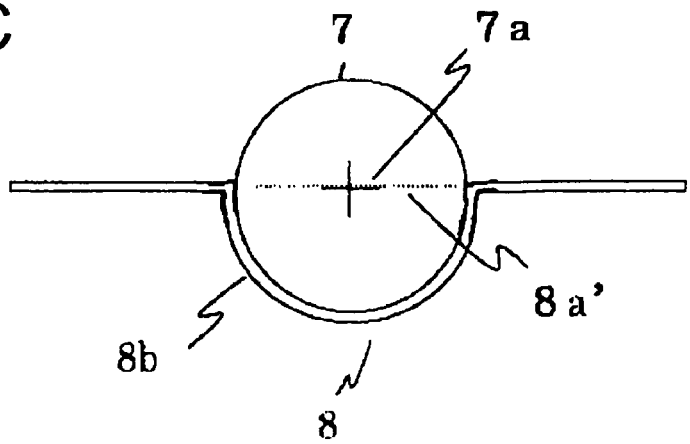
FIG. 4C is a diagram thereof wherein almost half of the electrode is fit in the curved portion 8*b;*

FIG. 4A is a diagram of the electrode 7 and the metallic foil 8 which are joined together wherein more than a half of the volume of the electrode 7 is fit in the curved portion 8*b*. FIG. 4B is a diagram thereof wherein almost the entire electrode 7 is fit in the curved portion 8*b*. FIG. 4C is a diagram thereof wherein almost a half of the volume of the electrode is fit in the curved portion 8*b*.

These structures are determined based on relation with current supplied therein and the size of the sealing portions 3. Specifically, the structure shown in FIG. 4C is superior in terms of preventing electrodes 6 and 7 from becoming eccentric. This is because the center of the sealing portion 3 is located at the center of the metallic foil 8, and it is also located at the center of the electrode 7.

The center 7*a* of the electrode 7 shown in FIG. 4C is located on a hypothetical broken line 8*a*' which extends from the plain surface portion 8*a*. For detail, the center 7*a* of the electrode 7 is located on the hypothetical line 8*a*' which is drawn at the middle of the plain surface portion 8*a* in the thickness direction.

For Example, when the thickness of the plain surface portion 8*a* of the metallic foil 8 is 20 μm, the center 7*a* of the electrode 7 is located on the hypothetical line 8*a* at a 10 μm distance from the surface of the plain surface portion 8*a*. Numerically expressed, the center 7*a* of the electrode 7 is preferably located within a range of a distance of 1/10 electrode diameter from the center of the sealing portion 3 or the curved surface portion 8*b* of metallic foil 8.

For Example, when the diameter of the electrode 7 is 1.0 mm, the center 7*a* of the electrode 7 is preferably located in a range of a 0.1 mm distance from the hypothetical line 8*a*' of the plain surface portion 8a, thereby bringing about the effect of preventing the electrode 7 from eccentric. The joint structure formed by the electrode 7 and the metallic foil 8 is not limited to the structures shown in FIGS. 4A, 4B, and 4C, and a structure in which the curved surface portion 8*a* of the metallic foil 8 covers only less than a half volume of the electrode 7 or 8 may be adopted.

The metallic foil 8 is formed in an omega shape by a press processing machine and the like.

The omega shape in the present invention does not mean a perfect omega (Ω) shape. For example, as long as the curved surface portion 8*b* covering the electrode 7 is formed, the plain surface portions 8*a* may not necessarily have a plain surface. For example, an edge on the light emitting portion side may be formed in a curved shape.

In addition, in a manufacturing process, it is advantageous that the curved surface portion 8*b* is formed along the full length of the metallic foil 8 as shown in FIG. 3B. However, for example, it is possible to change the width of the curved surface portion in case that the diameter of the electrode 7 or 8 and that of the outside lead 9 are different.

Figure 5A:
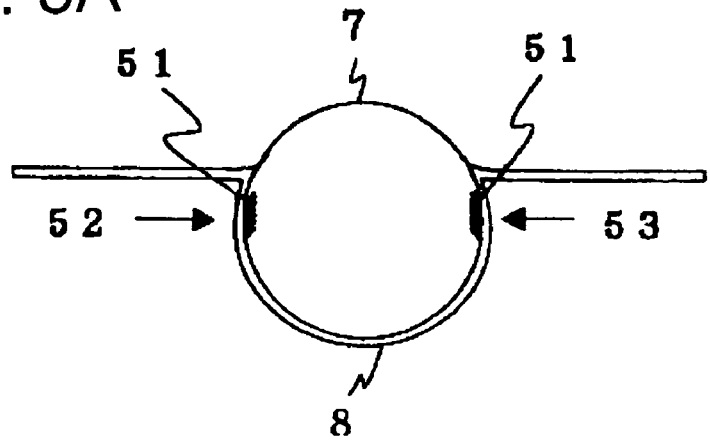
FIG. 5A is an enlarged view of the electrode and the metallic foil which are joined by a welding method according to the present invention.
Figure 5B:
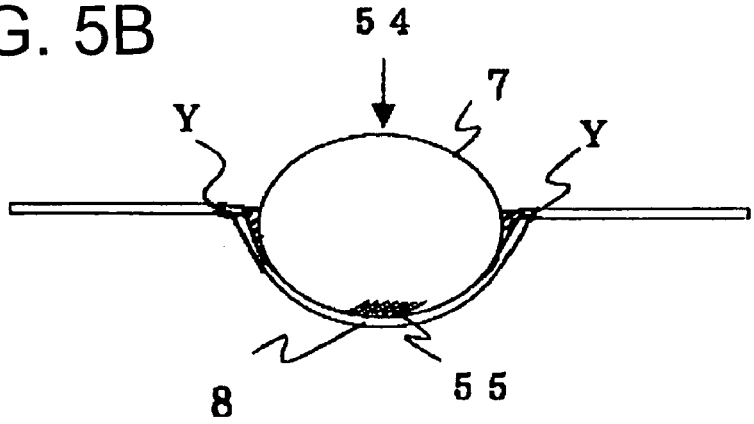
FIG. 5B is an enlarged view showing the electrode and the metallic foil which are joined by a conventional welding method for comparison purposes.

FIGS. 5A and 5B illustrate the joined electrode 7 and the metallic foil 8. FIG. 5A is an enlarged view of the electrode 7 and the metallic foil 8 which are joined by a welding method according to the present invention. FIG. 5B is an enlarged view showing the electrode 7 and the metallic foil 8 which are joined by a conventional welding method for comparison purposes.

That is, in FIG. 5A, since a welding rod contacts side portions of the electrode 7, welding points 51 are formed on both sides of the electrode 7 respectively. On the other hand, since in FIG. 5B, the welding rod contacts from above and beneath the electrode, a welding point 55 is formed at one point on a lower portion of the electrode 7. An arrow 54 shown in FIG. 5B shows a pressing direction of the welding rod.

By such a directional difference, the strength of the joint can be improved because of the number of the welding points. Further, the electrode 7 itself is transformed so as to spread in the horizontal directions after welding by press of the welding rod, thereby easily forming air gaps Y between the electrode 7 and the metallic foil 8 shown in FIG. 5B. On the other hand, in FIG. 5A, since the pressing direction of the welding rod is different from that shown in FIG. 5B, it is possible to prevent such undesirable air gaps.

As described above, it is possible to improve adhesiveness of the metallic foil 8 and the electrodes 6 and 7 by welding them from the side portions of the electrodes 6 and 7, and as a result, it is possible to prevent such undesirable air gaps.

The side portions of the electrode 7 can be welded after the electrode 7 and the metallic foil 8 are welded from above and beneath the electrode 7 as in conventional welding method.

Further, the welding area (welding point) where the metallic foil 8 and the electrode 7 are welded is preferably less than 0.3 $mm^2$.

An alloy of molybdenum which is a constituent material of the metallic foil 8 and tungsten which is a constituent material of the electrodes 6 and 7 is formed in the welding area when the electrode and the metallic foil 8 are welded, which produces a CTE (coefficient of thermal expansion) difference between the alloy portion and a portion of molybdenum near the welding portion thereby causing so-called film peeling phenomenon in the welding area.

An optimal value thereof in itself differs depending on conditions such as materials of the electrodes 6 and 7 and the metallic foil 8, size thereof, the structure of the discharge lamp and so on. Therefore, only the welding area may not be determined simply by the numeric in the proper sense. However, since the size of a discharge lamp or a projector etc. or specification thereof is approximately determined in general in case that the present invention is used as a light source thereof. Under such conditions, it is discovered that the welding area affects pressure withstand materially.

To give a concrete example, when the outer diameter of the electrode 7 is ϕ0.3 to 1.5 mm, and the width of the metallic foil 8 is in a range of 1.0 to 4.0 mm, a good result was obtained when the welding area was less than 0.3 $mm^2$.

Although the welding of the metallic foil 8 and the outer lead 9 may be carried out on side portions of the outer lead 9 as described above, they may be welded from above and beneath the electrode as in the conventional welding method since it is not necessary to take into consideration, air gaps formed between the metallic foil 8 and the outer lead 9 in terms of relation with a light emitting space in welding the metallic foil 8 and the outer lead 9.

After an electrode assembly in which the electrode 7, the metallic foil 8 and the outer lead 9 are connected in a row is completed, in the next process, for example, a shrink sealing process is carried. In the shrink sealing process, the electrode assembly is placed in the sealing portion 3 made of quartz glass, and the sealing process is carried out to the sealing portion 3, the glass being formed in a shape of the light emitting portion 2 and the sealing portion 3. The shrink sealing is different from pressure bonding (pinch sealing). In the pressure bonding, sealing is carried out in an instant by using a metallic mold, while in the shrink sealing method a sealing is carried out while heating the quartz glass.

The joint of the electrode 7 and the metallic foil 8 as described above is not limited to one for the anode 7 and may be applied for the cathode 6.

For the structure of the electrodes 6 and 7, when the diameter of the electrodes 6 and/or 7 in the light emitting portion 2 is large as shown in FIG. 1, the diameter of the electrode having a smaller diameter in the joint portion with the metallic foil 8 may be preferably used. When the electrode has a large diameter, the joint area with the metallic foil 8 becomes large thereby causing undesired air gaps easily.

In FIG. 1, the anode 7 has stepwise 3 diameters. The diameter in the light emitting portion 2 is, for example, 2.0 mm so that heat capacity can be increased by the electrode 7 having the large diameter.

In addition, the joint of the metallic foil 8 and the electrode 7 according to the present invention, can be used for not only an anode 7 but also a cathode 6. Further, the joint according to the present invention, can be applied for not only a direct current lighting type discharge lamp but also an alternating current lighting type discharge lamp.

Furthermore, the applicant invented a discharge lamp in which a small air gap is formed between an electrodes and respective sealing portions as described in Japanese Laid Open Patent No. 2001-351576.

Figure 6:
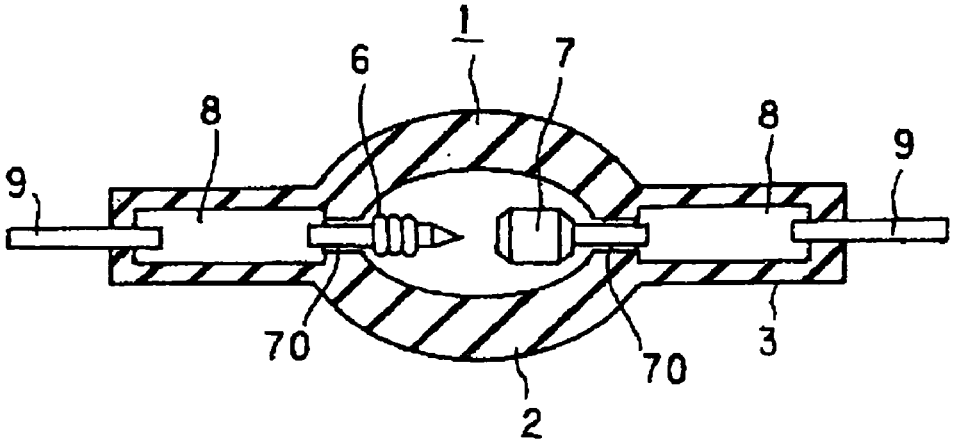
FIG. 6 a schematic view of a discharge lamp in which a subtle gap is formed between electrodes and respective part of quartz glass.
Figure 7:
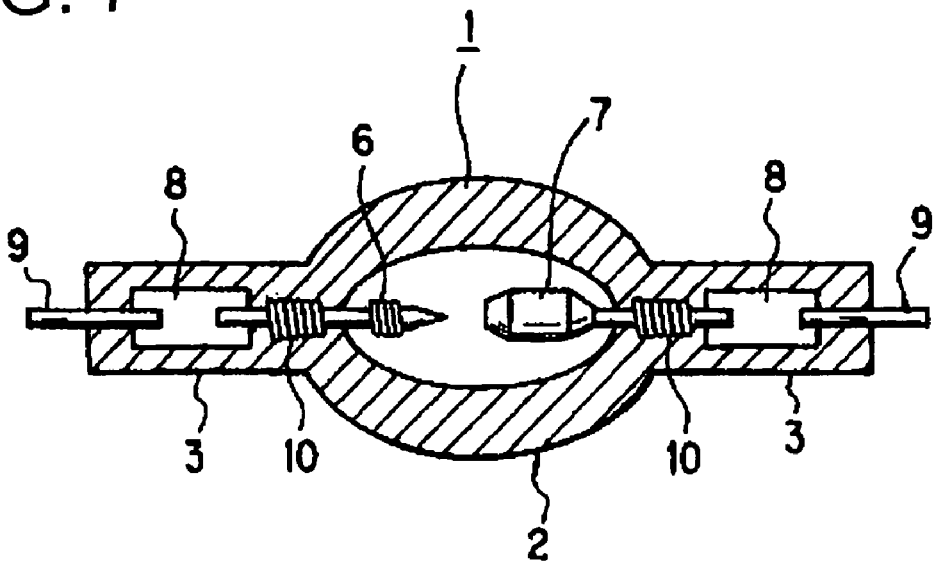
FIG. 7 shows a structure of a conventional discharge lamp.

FIG. 6 a schematic view of the discharge lamp in which the small air gap is formed between the electrodes 6 and 7 and the respective sealing portions 3 (part of quartz glass). In the light emitting portion 2, more than 0.15 mg/cc mercury is encapsulated and air caps are formed on an outer surface of the sealing portions 3 for the anode 6 and a cathode 7. Since when tungsten which is a constituent material of the electrode's 6 and 7 is in close contact with quartz glass which is a constituent material of the sealing portions 3, after the sealing process, they may be cracked because of expansion coefficient difference therebetween, the air gaps are formed respectively in order to make them expand and contract freely. The width of the air gaps is 5 to 20 μm.

In a discharge lamp having such a structure, since high voltage in the light emitting portion is directly applied to the joint of the electrodes 6 and 7 and the respective metallic foil 8, it is highly useful when the metallic foil structure capable of improving the pressure withstand strength according to the present invention is adopted Next, Experiments showing effects according to the present invention are described below.

In order to compare the film structure according to the present invention with the conventional film structure, pressure withstand tests were carried out. The film structure used in the test was the structure shown in FIGS. 2, 3, and 4C, whose structure was a so-called omega structure. For the conventional film structure, an entirely plain film on which an electrode was attached was used. The specification of these films was the same as each other except the film structures.

In addition, in the experiment, the film structure described above was formed on one sealing portion 3, and no film structure is formed on the other sealing portion. Therefore, the light emitting portion was connected to the outside thereby forming a pile structure, and no light emitting gas is encapsulated therein.

Alcohol is injected from the connecting path of the other sealing portion 3, and pressure was measured when the one sealing portion 3 bursts. It is so called static pressure withstand (alcohol) experiment.

The experiments were carried out using 10 film structures according to the present invention and 10 conventional film structures.

FIG. 9 shows results of these experiments and each value of the pressure in bursting is shown in MPas.

As shown in the results of the experiments, while the pressure withstand of the conventional film structures was about 14 to 16*b* MPa, that of the film structures according to the present invention was at least 19.8 MPa and more than 25 MPa (27.3 MPa)at maximum. While the average of 10 results of the experiments using the film structures according to the present invention was 21.92 MPa, that of the conventional film structures was 14.92 MPa. Thus difference therebetween was remarkable.

As described above, in the short arc type discharge lamp according to the present invention, the cross sectional view of the metallic foil is approximately omega shaped, thereby providing a film structure having a significantly high pressure withstand. Further, it is possible to prevent cracks even though the light emitting portion is turned on under extremely high mercury vapor pressure. Furthermore, by placing an electrode 7 or 8 in the curved surface portion 8*b* of the metallic foil 8 which is omega shaped, it is possible to prevent the electrodes 6 and 7 from becoming eccentric.

Figure 10:
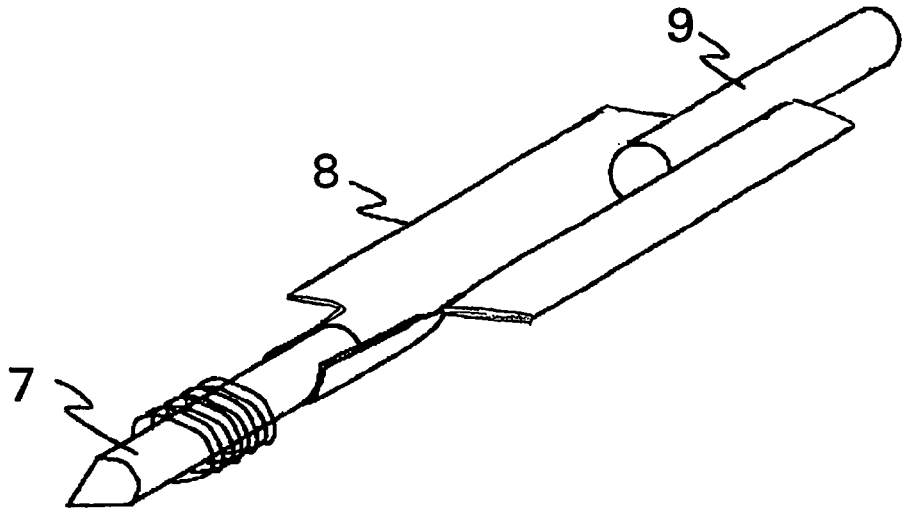
FIG. 10 shows a joint portion of a metallic foil and an electrode of the short arc type discharge lamp.

FIG. 10 shows a joint portion of the metallic foil 8 and the electrode 6 or 7 of the short arc type discharge lamp.

The joint portion of the metallic foil 8 and the electrode 7 is narrower than other part thereof. The electrode 7 is placed only in the narrower portion. In addition, the metallic foil 8 is approximately omega shaped in a cross sectional view.

By such a structure, it is possible to reduce occurrence of the air gaps between the metallic foil 8 and the electrode 7. Further, even though an air gap is formed therebetween, the electrode 7 exists only in the narrower portion thereby preventing growth of the air gaps.

Thus the present invention possesses a number of advantages or purposes, and there is no requirement that every claim directed to that invention be limited to encompass all of them.

The disclosure of Japanese Patent Application No. 2003-055410 filed on Mar. 3, 2003 including specification, drawings and claims is incorporated herein by reference in its entirety.

Although only some exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention.

Further, the present invention possesses a number of advantages or purposes, and there is no requirement that every claim directed to that invention be limited to encompass all of them.

What is claimed is:

1. A short arc type high pressure discharge lamp comprising:

a pair of electrodes disposed inside the discharge lamp and facing each other, a light emitting portion, a sealing portion that extends to a side of the light emitting portion and seals part of one of the electrodes, and a metallic foil that is sealed in the sealing portion, wherein the one of the electrodes and the metallic foil are joined in the sealing portion, and wherein the metallic foil is formed in an approximately omega shape in a cross-sectional view thereof, and at least one welding trace where the metallic foil and the one of the electrodes are welded is located on a curved line of the approximately omega shape in a cross-section of the metallic foil.

2. The short arc type high pressure discharge lamp according to claim 1, wherein two welding traces are formed on the curved line of the approximately omega shape.

3. The short arc type high pressure discharge lamp according to claim 1, wherein the curved portion is formed over an entire length of the metallic foil.

4. The light short arc type high pressure discharge lamp according to claim 1, wherein the light emitting portion contains more than 0.15 $mg/mm^3$ mercury.

5. The short arc type high pressure discharge lamp according to claim 2, wherein the two welding traces are formed from a width direction of the metallic foil.

6. A method of welding an electrode and a metallic foil, comprising steps of:

press processing a metallic foil to form a curved surface portion so that a cross-sectional view of the metallic foil is in an approximately omega shape, placing the electrode in the curved surface portion, and welding the metallic foil and the electrode at a curved surface portion of the omega shape of the metallic foil.

7. A short arc type high pressure discharge lamp having an electrode assembly made by the method according to claim 6.

* * * * *